US005678241A

United States Patent [19]

Wilson et al.

[11] Patent Number: 5,678,241

[45] Date of Patent: Oct. 14, 1997

[54] PROCESS FOR CONCENTRATING THORIUM CONTAINING MAGNESIUM SLAG

[75] Inventors: David A. Wilson, Richwood; Jaime Simon, Angleton; Garry E. Kiefer, Lake Jackson, all of Tex.

[73] Assignee: The Dow Chemical Company, Midland, Mich.

[21] Appl. No.: 748,965

[22] Filed: Nov. 13, 1996

Related U.S. Application Data

[63] Continuation of Ser. No. 522,638, Sep. 1, 1995, abandoned.

[51] Int. Cl.[6] ..... G21F 9/00

[52] U.S. Cl. ..... 588/19; 423/11; 423/158; 423/166; 588/20

[58] Field of Search ..... 423/11, 158, 166; 588/19, 20

[56] References Cited

U.S. PATENT DOCUMENTS

| | | | |
|---|---|---|---|
| 2,733,126 | 1/1956 | Spiegler . | |
| 2,932,555 | 4/1960 | Flynn | 423/11 |
| 3,305,302 | 2/1967 | Heuer | 423/163 |
| 3,980,753 | 9/1976 | Grill et al. | 423/161 |
| 4,689,178 | 8/1987 | Gay et al. | 252/626 |
| 4,783,253 | 11/1988 | Ayres | 209/2 |
| 5,223,181 | 6/1993 | Wilson et al. | 252/631 |

OTHER PUBLICATIONS

*Energy Digest 15(4), 10–15 (1986), World Status of Radioactive Waste Management.

*Karl heinz et al., Nuclear Enginering and Design, 118, 115–121 (1990), Volume Reduction, Treatment and Recycling of Radioactive Waste.

*Low level Radioactive Waste Reduction and Stabilization technologies Resource Manual, Dec.1988 by Ebasco Services Inc.

*A. H. Kibbey and H. W. Gadbee, A State of the Art Report on Low–Level Radioactive Waste Treatment (1980).

*Technological Approaches to the Cleanup of Radiologically Contaminated Superfund Sites, by the U.S. Environmental Protection Agency, No. EPA/540/2–88/002 (Aug. 1988).

*Raghaven et al. U.S. Environmental Protection Agency Research Division, (EPA (1989), IPA/600/9–89/072, Int. Conf. New Front Hazard Waste mamagement, 3d Ed., 59–66 (1989).

*D. Bradbury, Development of Chemical Methods of radioactive Waste management for U. K. Power Reactor Sites, pp. 377–380 (Apr. 19–22, 1982).

*D. Bradbury et al., Magnox Dissolution in carbonated Water . . . , Water Chem., 3, pp. 345–352 (1983).

*Burns, Michael E., Low–level Radioactive Waste Regulation (1988).

*Primary Examiner*—Ngoclan Mai

[57] ABSTRACT

The present invention describes a process to reduce the volume and/or weight of magnesium slag when the magnesium slag contains radioactive thorium. The process contacts the magnesium slag as an aqueous slurry with an acid in a pH range from about 4.0 to about 8.0, preferably from about 5.0 to about 5.5, followed by separating insoluble solids from the aqueous solution. Optionally, the acid digested solids are heated, either before or after the acid digestion, at a temperature from about 350° to about 500° C. The solid waste can then be further compacted, if desired, prior to disposal.

20 Claims, 6 Drawing Sheets

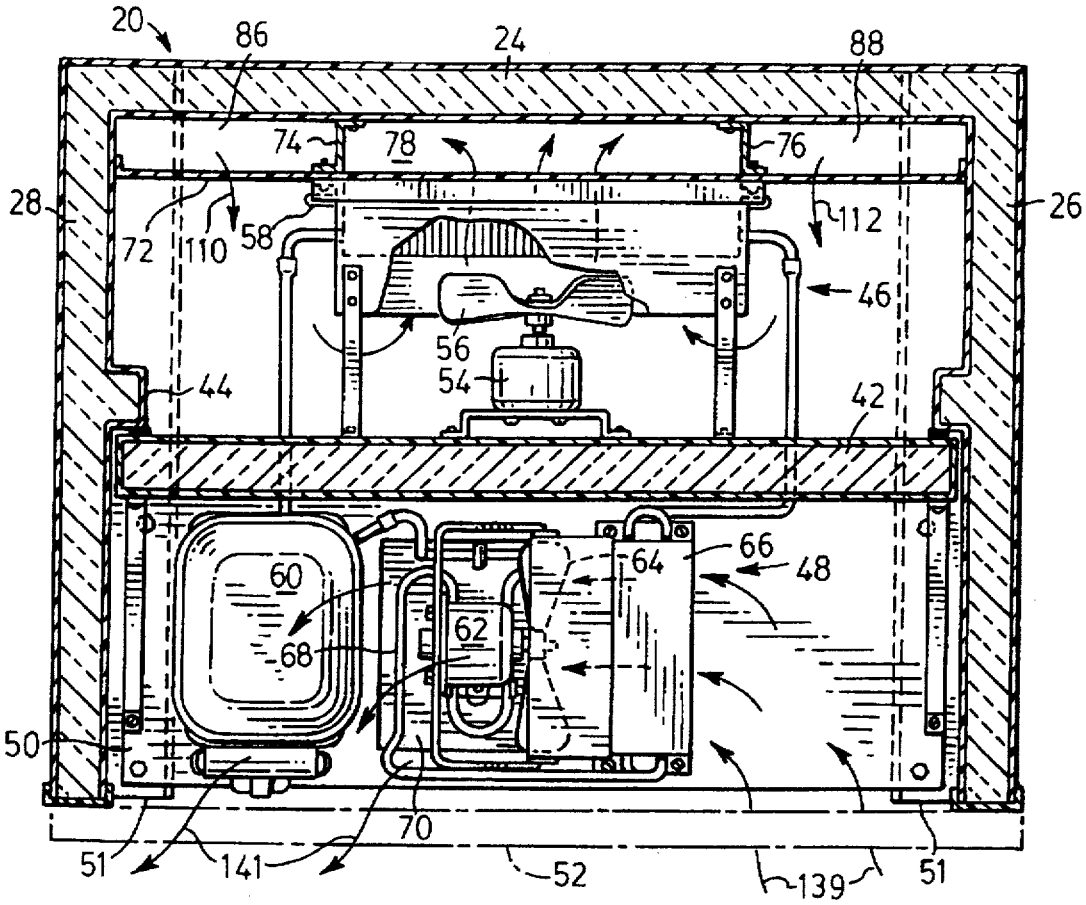
FIG. 2
FIG. 3
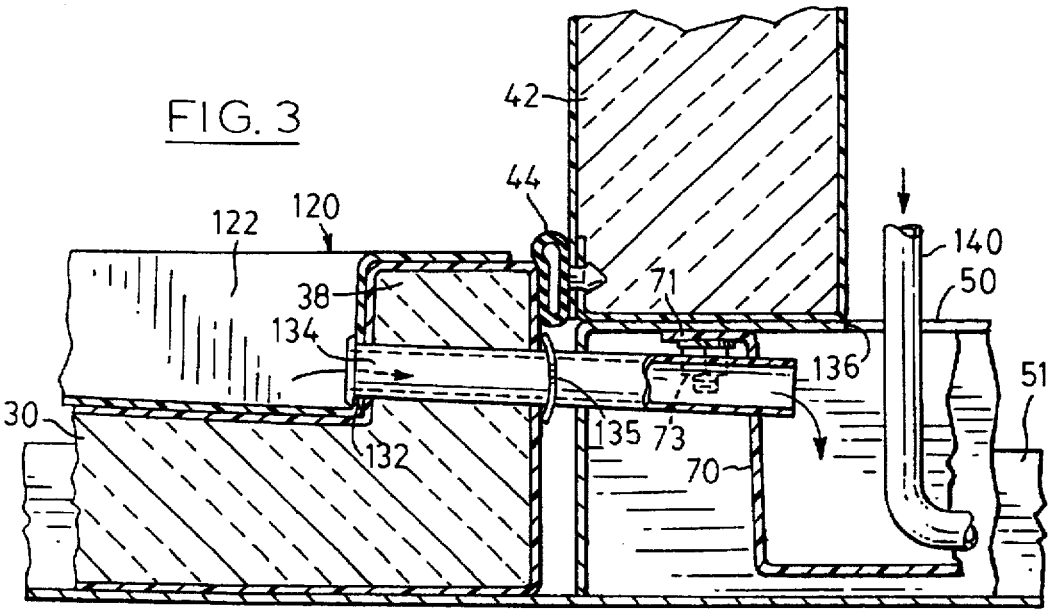

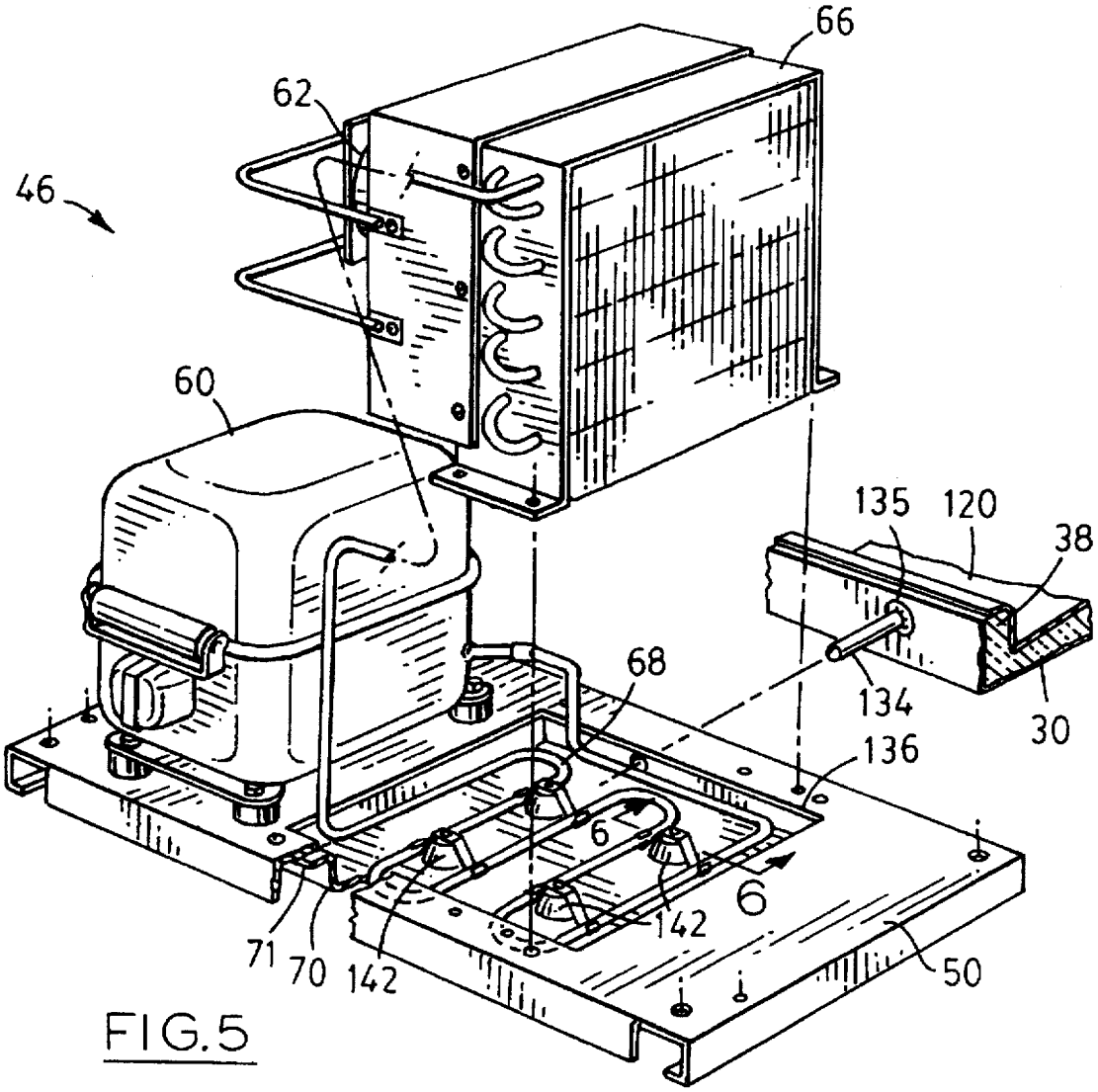
FIG.5
FIG.6
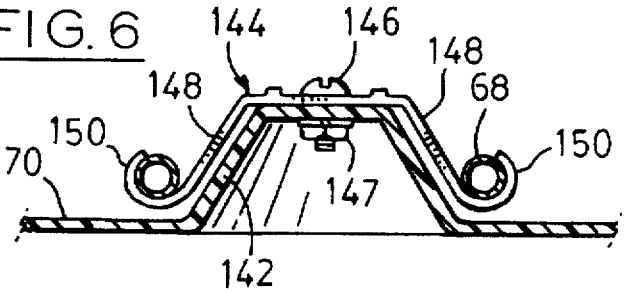

PROCESS FOR CONCENTRATING THORIUM CONTAINING MAGNESIUM SLAG

CROSS-REFERENCE TO RELATED APPLICATION

This is a continuation of application Ser. No. 08/522,638, filed Sep. 1, 1995 abandoned.

FIELD OF THE INVENTION

The present invention concerns a process for reducing the amount of thorium bearing radioactive waste thereby reducing the cost for disposal.

BACKGROUND OF THE INVENTION

Radioactive waste sites exist in the United States that contain large volumes of material, several sites are in excess of 100,000 cubic yards. The number of such sites and concern for their management has significantly increased over recent years because of renewed concern over environmental issues, including the disposal of radioactive waste. The best method for the removal of radioactivity from such sites and their long term disposal requirements concerns many governmental agencies and private industry. The number of these sites that can treat and handle the huge amounts of radioactive waste are limited, due in part to the difficulty in identifying and siting new treatment and disposal facilities.

Usual processing of these radioactive sites requires the treatment of large quantities of material, only a portion of which is in fact usually radioactive. Because of tremendous difficulties in economically treating such massive quantities of material to remove the radioactive portion and also meet the radioactivity level requirements for disposal set by government agencies, the best disposal method employed to date has been burial of the radioactive material. The burial method requires hauling large quantities of material, that are regulated as radioactive waste material, frequently many miles to an approved burial site. Therefore, economical methods for the reduction of the volume and/or weight of the radioactivity for disposal at these sites have been actively sought.

Several methods for a volume and/or weight reduction of radioactive waste have been explored in the literature. Examples of review articles that describe the issues are:

- *Energy Digest* 15(4), 10–16 (1986), "World Status of Radioactive Waste Management";
- Karl Heinz et al., *Nuclear Engin. and Design* 118, 115–122 (1990), "Volume Reduction, Treatment and Recycling of Radioactive Waste";
- "Low-Level Radioactive Waste Reduction and Stabilization Technologies Resource Manual" (December 1988) by Ebasco Services Inc., Bellevue, Wash. for EG&G Idaho, Inc. under subcontract C85-131069 and for the U.S. Department of Energy, Idaho Operations Office under contract DE-ACO7-76ID01570;
- A. H. Kibbey and H. W. Godbee, "A State-of-the-Art Report on Low-Level Radioactive Waste Treatment", Oak Ridge National Laboratory, Oak Ridge, Tenn. under the Nuclear Waste Programs ORNL/TM-7427 (1980); and
- "Technological Approaches to the Cleanup of Radiologically Contaminated Superfund Sites" by the U.S. Environmental Protection Agency, No. EPA/540/2-88/002 (August 1988).

When the radioactive component is a solid, then various physical separation techniques have been investigated based on methods involving: screening; classification; gravity concentration; and/or physical separation using flotation. The screening technique separates components on the basis of size and can be used either on dry material or water can be added, the material is separated by passing it through certain size screens. The classification technique is used to separate particles of material based on their settling rate in a liquid. The gravity concentration technique utilizes density differences to separate materials into layers. The flotation technique is based on physical and chemical phenomena as well as particle size differences. One technique based on gravity and particle size differences is taught in U.S. Pat. No. 4,783,253. In general, however, physical separation techniques will not be useful if the radioactive material is distributed uniformly within each particle size throughout all of the components comprising the mixture.

When the radioactive component is in solution, then filtration, carbon treatment, ion exchange, and/or precipitation techniques are often used. Care must be exercised if a person is considering using any one of these techniques, since a high degree of selectivity is required. For example, a precipitation technique may concentrate the majority of the radionuclides in a solid matrix, but if the precipitation was not quantitative, then the solution from which the precipitation was preformed may still have sufficient radioactivity to be of concern for disposal. Thus if the process is not selective, the total volume of material for disposal after such processing can increase. These concerns have been raised by Raghaven et al. ["Technologies Applicable for the Remediation of Contaminated Soil at Superfund Radiation Sites", *U.S. Environ. Prot. Agency Res. Dev.*, [Rep.] EPA (1989), EPA/600/9-89/072, Int. Conf. New Front. Hazard. Waste Management, 3rd. ed., 59–66 (1989)] where they indicate that of the 25 contaminated Superfund sites discussed that no chemical extraction or physical separation techniques have actually been used in a remediation situation and that their use must be approached with extreme caution.

Some volume reduction techniques involve the use of incinerators and compactors. If incineration is used, then the off-gases and particulates that are produced must be constantly monitored and treated to ensure that radioactivity is not being released to the environment. Supercompactors, which are compactors that can exert forces in excess of 1,000 tons, have been used to achieve even greater reductions in volume. However, these supercompactors represent a very large capital investment.

Volume reductions based on chemical extraction techniques using mineral acids have been reported. For example, U.S. Pat. No. 4,689,178 discloses the use of sulfuric acid in the recovery of magnesium sulfate from a slag containing magnesium and uranium metal and the oxides, fluorides and mixed oxides and fluorides of the metals. The desired outcome is that the radioactivity will occupy less volume than it did in the original slag. A similar process is described in U.S. Pat. No. 2,733,126.

U.S. Pat. No. 5,223,181 discloses a process for selectively concentrating the radioactivity of thorium containing magnesium slag which extracts magnesium from the magnesium slag (containing radioactive thorium and its daughters) by forming an aqueous magnesium slurry from the magnesium slag and water. The slurry is then solubilized with carbon dioxide and selectively concentrates the radioactive thorium and its daughters such that the radioactivity is separated from the magnesium, followed by reducing the volume for disposal.

A process for the treatment of Magnox fuel element debris is described by D. Bradbury in "Development of Chemical Methods of Radioactive Waste Management for U. K. Power Reactor Sites", ANS/DOE Treatment & Handling of Radioactive Wastes (Batelle/Springer-Verlag) Conf., Richland, Wash., pp. 377–380 (Apr. 19–22, 1982). Magnox alloy consists essentially of magnesium metal where about 1% of other alloying elements have been added. After irradiation, the levels of long-lived radioisotopes is reported to be low. Minor constituents in the waste debris, for example the approximately 5 G springs that are used with the spent Magnox fuel elements are produced from a nickel alloy that contains small amounts of cobalt. During irradiation the cobalt becomes activated to give cobalt-60 and the resulting radioactivity of the springs is far greater than from the irradiated Magnox. The process to isolate the radioactive debris from the Magnox alloy involves corroding away the magnesium in an aqueous medium. The process is conducted in a batch wise manner with large quantities of rapid flowing fresh water with carbon dioxide sparging. Care must be taken to maintain the magnesium concentration below the solubility limit, hence the large quantities of water. Since the dissolution also produces hydrogen gas with an exothermic reaction, proper handling techniques are required. A typical Magnox batch dissolution would take 20 days. The degree of dissolution of some of the radionuclides associated with the Magnox process is given by Bradbury et al. in "Magnox Dissolution in Carbonated Water. A Method of the Separation and Disposal of Magnox from Fuel Element Debris Waste", *Water Chem.* 3, 345–352 (1983) BNES, London. For cobalt-60, 29% was dissolved in the effluent.

The above issues have resulted in large increases in cost associated with the disposal of waste [see, for example, "Low-Level Radioactive Waste Regulation", ed. Michael E. Burns, pub. Lewis Publishers, Inc. (1988)]. The need therefore to minimize the amount of radioactive waste that has to be placed in an approved landfill or treated in other ways has become of critical importance.

SUMMARY OF THE INVENTION

Surprisingly, it has now been found that significant reduction in the volume and/or weight of magnesium slag containing radioactive thorium can be achieved. The present process provides a method to separate thorium bearing radioactive waste from magnesium slag by acid digestion at a pH of from about 4.0 to about 8.0 of an aqueous slurry of the slag material, followed by separating the insoluble solids from the aqueous solution. Preferably the acid digestion is done at a pH from about 5.0 to about 5.5. After the acid digestion, if desired, further reduction in the volume and/or weight of slag can be obtained by heating the solids material from the acid digestion. The heating is done at a temperature from about 350° to about 500° C. The solid waste can then be further compacted, if desired, prior to disposal.

DETAILED DESCRIPTION OF THE INVENTION

Figure 1:
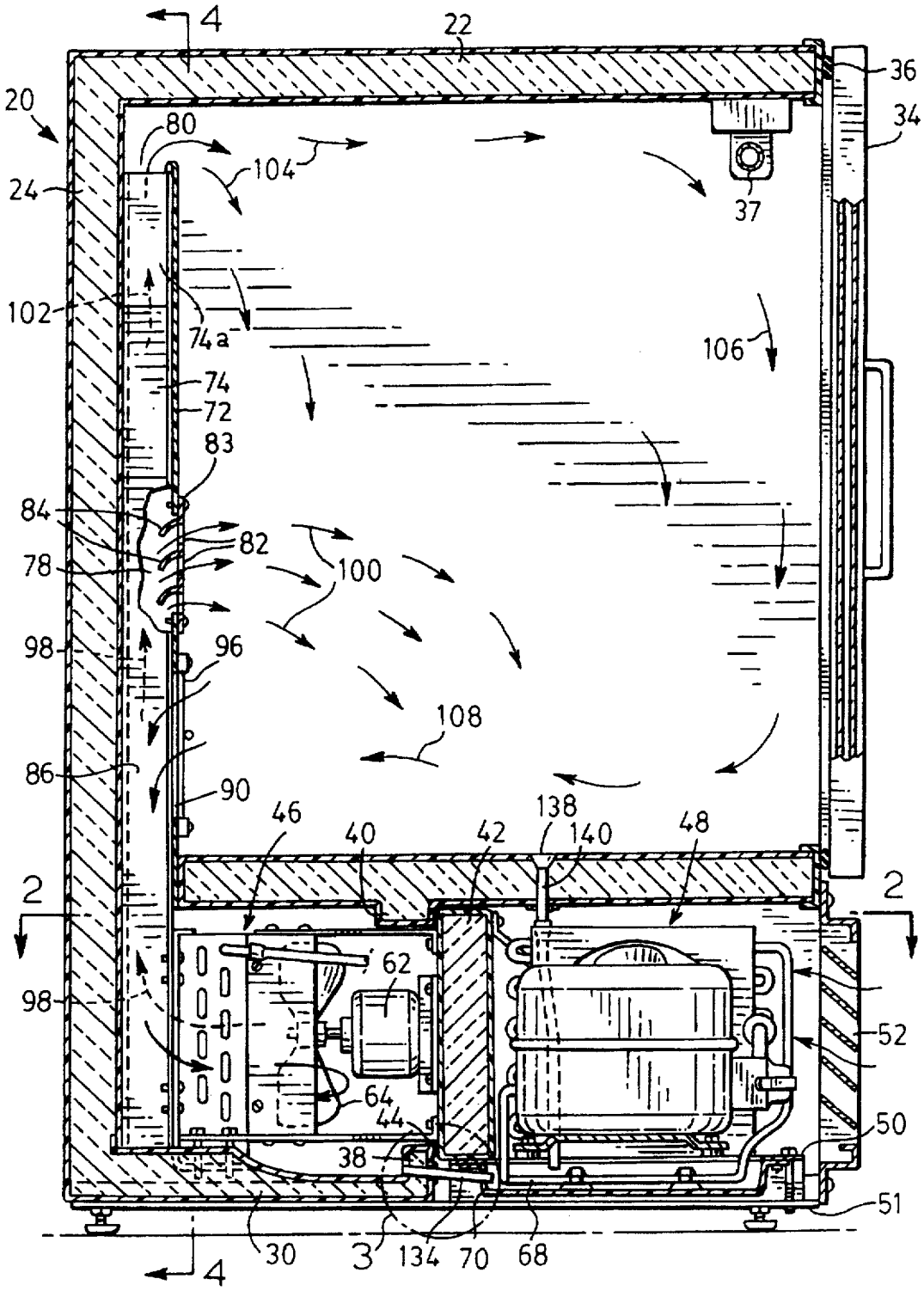
Figure 4:
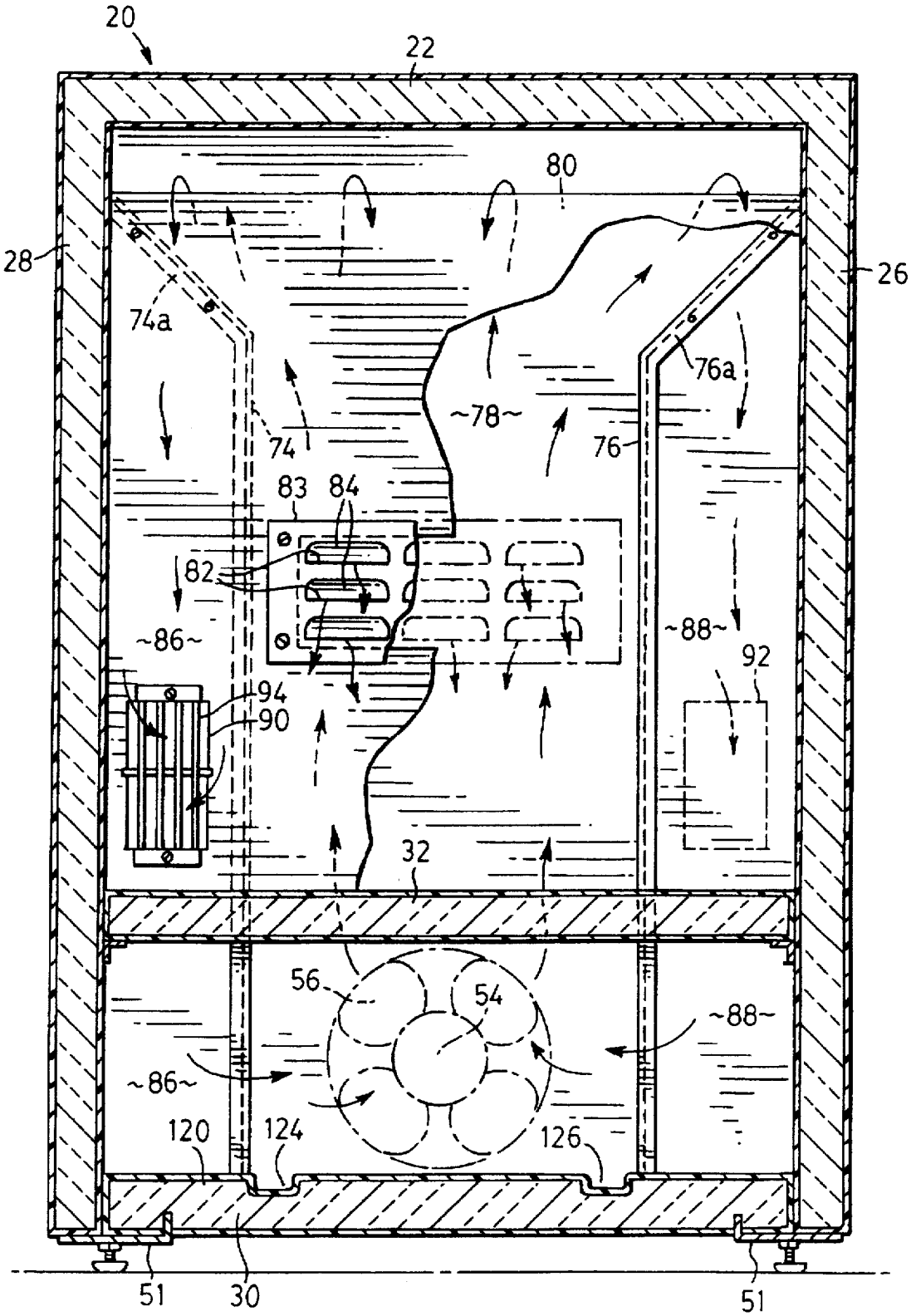
Figure 7:
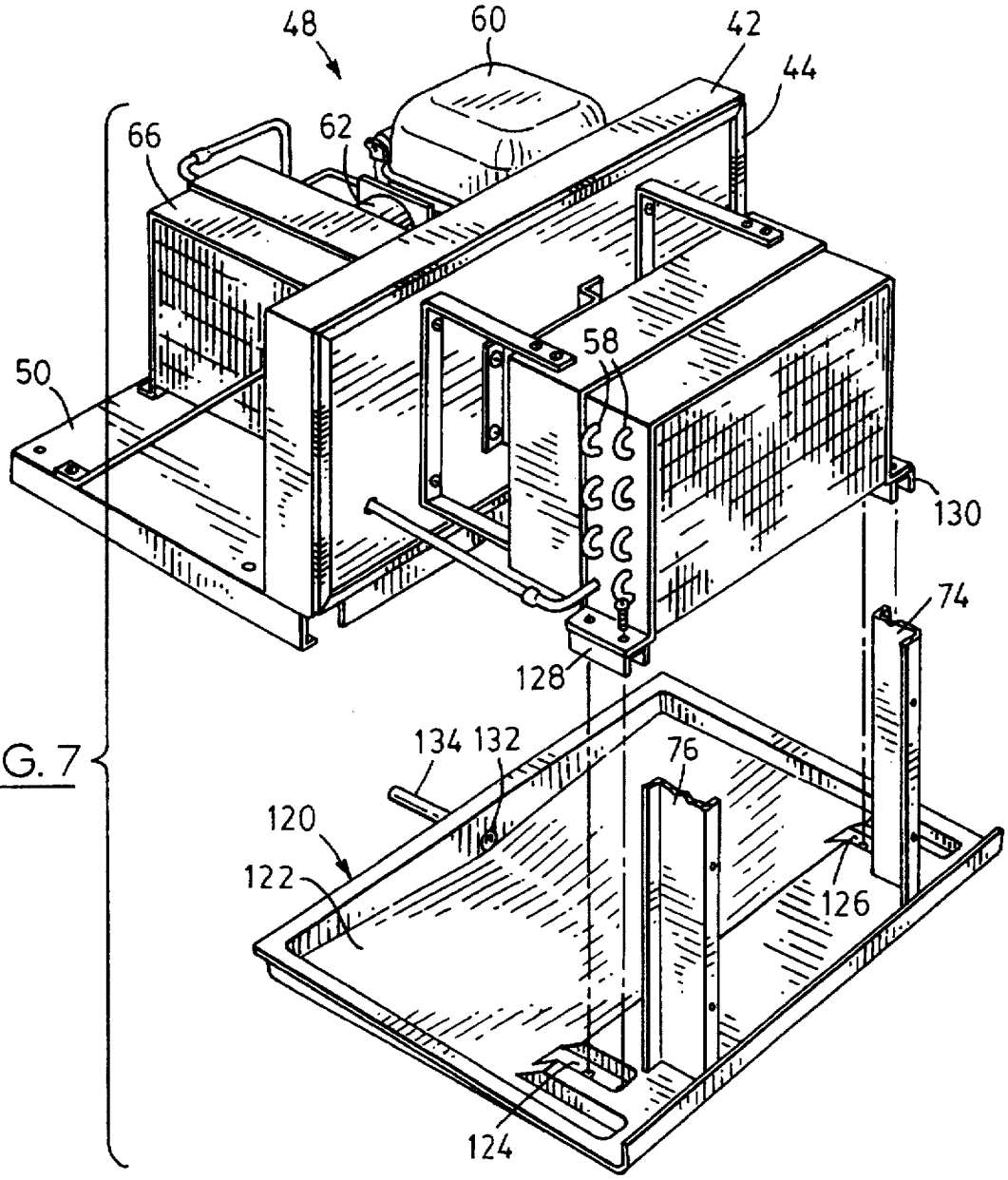
Figure 8:
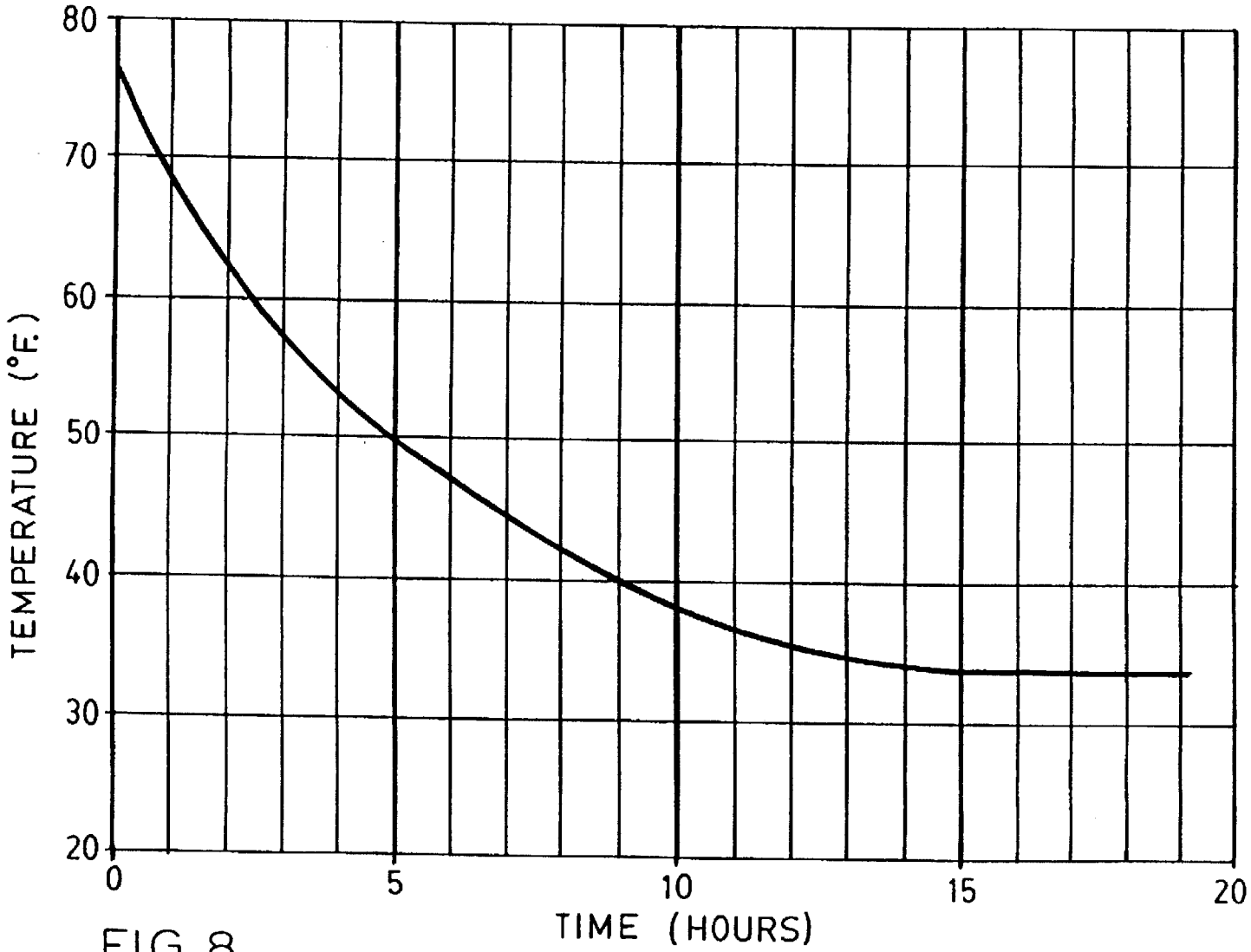

The present invention provides a process for reducing the volume and/or weight of thorium bearing radioactive waste for disposal from radioactive contaminated sites, thereby significantly reducing the cost for radioactive burial. The present process also allows for the recovery of valuable magnesium compounds for resale. The process is also economical to run on large volumes of material, using reagents that can easily be brought to the site for processing and can be recycled, and does not result in further disposal problems for the reagents or by-products from the process.

The present invention provides a process for reducing the amount of thorium bearing radioactive waste, thereby significantly reducing the cost of disposal, e.g. preferably by burial. The process involves a controlled acid digestion (with aqueous hydrochloric, sulfuric, acetic or nitric acid) of thorium containing magnesium slag at a specific pH range, i.e., about 4.0 to about 8.0. The preferred pH range is about 5.0 to about 5.5. At this pH significant reductions are realized with minimum solubilization of thorium. Insoluble solids are then separated from the aqueous solution. The largest reductions in the amount of slag are obtained by combining an acid digestion step with a separate heating step (either prior to the above acid digestion step or subsequent to the acid digestion step) at a temperature in the range of from about 350° to about 500° C. Preferably, the acid digestion step is followed by the heat treatment step. The waste is then compacted for further reduction in volume and/or weight, if desired, for burial. Thus, the present process reduces the volume and/or weight of magnesium slag containing radioactive thorium comprising:

A) optionally heating the magnesium slag at a temperature in the range of from about 350° to about 500° C.;

B) contacting an aqueous slurry of the magnesium slag with an acid at a pH from about 4.0 to about 8.0, followed by separating insoluble solids from the aqueous solution;

C) optionally heating the magnesium slag from B) at a temperature in the range of from about 350° to about 500° C.;

D) optionally compacting the solids.

Typically, the non-radioactive components of the magnesium slag include as the major component, hydromagnesite [4 $MgCO_3.Mg(OH)_2.4\ H_2O$], and as minor components $BaMg(CO_3)_2$ and $Mg_6Al_2CO_3(OH)_{16}.4H_2O$ and others. Thus the starting material used in the present process termed "magnesium slag" includes both the radioactive and non-radioactive components. The magnesium slag is typically a heterogeneous mixture of the components.

The acids used for digestion are aqueous hydrochloric acid (HCl), aqueous sulfuric acid ($H_2SO_4$), aqueous acetic acid ($CH_3CO_2H$) or aqueous nitric acid ($HNO_3$). When HCl is used a pH range from about 4.0 to about 7.0 is possible. The barium, when present, is usually dissolved from the slag when treated with HCl. However, dissolution of the barium can be minimized by the addition of a small amount of sulfate anion. The amount of soluble sulfate anion to be added should be at least the equivalent amount required to react with the soluble barium to produce insoluble barium sulfate. When $H_2SO_4$ is used, a pH range from about 4.0 to about 8.0 is possible. When $H_2SO_4$ is used, the barium present in the slag is not usually dissolved. Thus for the acid digestion the pH may range from about 4.0 to about 8.0. The preferred pH range is about 5.0 to about 5.5. If a pH below about 5.0 is used, then the thorium begins to dissolve. If a pH above about 5.5 is used, then the magnesium does not go readily into dissolution. The acid digestion step of the slag allows the inert portion containing the magnesium to be separated from the radioactive thorium which is left behind. This acid digestion results in a volume reduction of the magnesium slag by at least 40%, generally in the range of from about 40 to about 60%. Thus, at this preferred pH range significant reductions in volume of waste are realized with minimum solubilization of thorium.

The temperature and pressure for the acid digestion is not critical and is usually ambient pressure and temperature. The concentration of the magnesium slag in the aqueous medium is also not critical but for economy of operations is usually at least about 0.1 g/mL. The separation of the insoluble solids from the aqueous solution is done by methods known in this art, e.g., filtration, centrifugation, and sedimentation.

The largest reductions in the amount of volume and/or weight of magnesium slag is obtained by combining the above described acid digestion step with a heating step. This heating step can be done either prior to or subsequent to the above described acid digestion step.The temperature range for the heating step is from about 350° to about 500° C. This heating step can provide and additional reduction in the volume and/or weight of waste in the range of from about 40 to about 60%.

When desired, the last step is normally a final compaction of the material prior to shipping. When this step is also included, the increased reduction in the volume of waste is in the range of from about 40 to about 70%.

Thus if all three process steps are employed, the total reduction in the volume and/or weight of waste is in the range of from about 80 to about 95%.

The invention will be further clarified by a consideration of the following examples, which are intended to be purely exemplary of the present invention.

EXAMPLE 1

A sample of magnesium slag was dried in a vacuum oven at 60°–65° C. until a constant weight was obtained. Fifty grams (g) of the dried magnesium slag material were placed in a beaker, 150 milliliters (mL) of deionized water were added, and the slurry was agitated using a magnetic stir bar. Various amounts of 1.5M sulfuric acid ($H_2SO_4$) were added to the slurry and the slurry stirred. The pH was measured after each addition of $H_2SO_4$. The concentration of metals (in solution) was determined by atomic emission spectroscopy. The results are shown in Table 1 below.

TABLE 1

DIGESTION OF MAGNESIUM SLAG WITH 1.5M $H_2SO_4$

| mL of $H_2SO_4$ Used | Ph | PPM Th | PPM Mn | PPM Fe | PPM Mg | PPM Al | PPM Ba |
|---|---|---|---|---|---|---|---|
| 0 | 9.5 | 0 | 0 | 0 | 0 | 0 | 0 |
| 50 | 7.8 | 1.2 | 186 | 0 | >1% | 0 | 0 |
| 130 | 6.3 | 3.2 | 501 | 0 | >1.5% | 0 | 0 |
| 210 | 5.2 | 3.4 | 3900 | 0 | >1.5% | 94 | 0 |
| 230 | 4.5 | 24 | 5125 | 0 | >2% | 2400 | 0 |
| 250 | 3.6 | 364 | 6088 | 41 | >2% | 9933 | 0 |
| 260 | 2.8 | 521 | 8221 | 265 | >2% | 12500 | 0 |

This data shows that as the pH drops below about 5, that thorium begins to dissolve. Whereas when the pH is above about 8, very little magnesium from the slag is dissolved.

EXAMPLE 2

Fifty g of dried magnesium slag were placed in a beaker and 150 mL of deionized water were added. The slurry was mixed with a magnetic stirrer. Various amounts of 3M hydrochloric acid (HCl) were added with stirring. The pH of the slurry was measured after each addition of HCl. The concentration of metals in solution was determined by atomic emission spectrometry. The results are shown in Table 2 below.

TABLE 2

DIGESTION OF MAGNESIUM SLAG WITH 3M HCl

| mL of HCl Added | Ph | PPM Th | PPM Mn | PPM Fe | PPM Mg | PPM Al | PPM Ba |
|---|---|---|---|---|---|---|---|
| 0 | 9.5 | 0 | 0 | 0 | 0 | 0 | 0 |
| 20 | 7.3 | 0 | 0 | 0 | 0 | 0 | 1600 |
| 90 | 6.8 | 0 | 319 | 0 | >2% | 0 | 6450 |
| 170 | 5.7 | 0 | 1390 | 0 | >2% | 0 | 11550 |
| 270 | 5.5 | 2.5 | 3170 | 0 | >2% | 0 | >1.5% |
| 310 | 4.8 | 6.4 | 4950 | 0 | >2% | 0 | >1.5% |
| 330 | 3.6 | 40 | 6450 | 0 | >2% | 4830 | >1.5% |
| 340 | 2.6 | 312 | 7075 | 79 | >2% | 8160 | >1.5% |
| 350 | 2.0 | 884 | 8680 | 955 | >2% | — | >1.5% |

This data shows that as the pH drops below about 5, that thorium begins to dissolve. Whereas, when the pH is above 7, very little magnesium from the slag is dissolved.

EXAMPLE 3

Twenty g of dried magnesium slag and 60 g of deionized water were weighed into a beaker and stirred with a magnetic stirrer. The initial pH of the slurry was 9.4. HCl (18%) was added to the magnesium slag slurry. The pH was maintained at approximately 5.5 by the periodic addition of HCl. After 46 hours, the pH had stabilized. The total amount of 18% HCl used was 70.6 g. The mixture was filtered under vacuum and the solids washed with a small amount of deionized water. The solids were dried in a vacuum oven at 60°–65° C. for several hours. After drying, 7.9 g of material were collected representing 61% loss in weight.

EXAMPLE 4

The acid treated solids (7.9 g) from Example 3 were heated in an oven at 460° C. for 2.5 hours. The overall weight loss was 82%. The solids were then ground using a mortar and pestle and placed in a graduated cylinder. The cylinder was then tapped on a table top to settle or compress the solids. A final volume of 6 mL was obtained. In an analogous manner, a sample (20.0 g) of the original dried magnesium slag was placed in a similar graduated cylinder and tapped on a table top settle the material. The magnesium slag occupied 31 mL. An overall volume decrease of 81% of the acid and heat treated solid compared to the slag was obtained.

EXAMPLE 5

A sample of dried magnesium slag (357.3 g) was heated in an oven at 500° C. The material was then added to a 2000 mL beaker. Approximately 800 mL of deionized water were added and the slurry stirred with a magnetic stirrer. The initial pH was 12.0. HCl (18%) was added to adjust the pH to 5.3 and then more HCl was added using a pH controller that added HCl (18%) when the pH increased above 5.5. The pH was thus controlled between 5.3–5.5. After 78.5 hours, the pH had stabilized. The total amount of HCl used was 1341 g. The mixture was then filtered under vacuum and dried in a vacuum oven at 65°–70° C. until a constant weight was obtained. The solids weighed 88.2 g, representing a 75% decrease in weight.

EXAMPLE 6

The solids (88.2 g) from Example 5 were placed in an oven and heated at 480° C. until a constant weight was obtained. After heating, 55.6 g were collected, representing an additional 37% weight loss. An overall weight loss of 84% was obtained. The material was mixed thoroughly with 20.0 g of deionized water and compacted. The final compacted volume was 50 mL. The original dried magnesium slag (357.3 g) occupied a volume (after settling) of 550 mL. Thus an overall volume decrease of about 91% was obtained.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

What is claimed is:

1. A process for reducing the volume and/or weight of magnesium slag containing radioactive thorium comprising contacting an aqueous slurry of the magnesium slag with an acid at a pH from about 4.0 to about 8.0, followed by separating insoluble solids from the aqueous solution.

2. The process of claim 1 wherein the volume of radioactive solids for disposal as radioactive waste has been reduced by at least about 40%.

3. The process of claim 2 wherein the volume of radioactive solids for disposal as radioactive waste has been reduced from about 40% to about 60%.

4. The process of claim 1 wherein the acid used is hydrochloric acid, sulfuric acid, acetic acid or nitric acid.

5. The process of claim 1 wherein the pH is from about 5.0 to about 5.5.

6. The process of claim 5 wherein the acid used is hydrochloric acid or sulfuric acid.

7. The process of claim 5 wherein the acid used is hydrochloric acid and sulfate is added.

8. The process of claim 1 wherein the volume of radioactive solids is further reduced from about 40 to about 70% by compacting the solids.

9. The process of claim 1 wherein the solids remaining after the acid treatment are then heated at a temperature in the range of from about 350° to about 500° C.

10. The process of claim 9 wherein the radioactive waste has been reduced from about 40 to about 60%.

11. The process of claim 9 wherein the volume of radioactive solids is further reduced from about 40 to about 70% by compacting the solids.

12. The process of claim 11 wherein the volume of radioactive solids is reduced overall from the steps of acid digestion, heating and compacting by about 80 to about 95%.

13. The process of claim 1 wherein a pretreatment of the magnesium slag prior to the acid digestion is done by heating the magnesium slag at a temperature in the range of from about 350° to about 500° C.

14. The process of claim 13 wherein a second heating treatment of the magnesium slag after the acid digestion is done by heating the magnesium slag at a temperature in the range of from about 350° to about 500° C.

15. A process for reducing the volume and/or weight of magnesium slag containing radioactive thorium comprising:

A) heating the magnesium slag at a temperature in the range of from about 350° to about 500° C.;

B) contacting an aqueous slurry of the magnesium slag with an acid at a pH from about 4.0 to about 8.0, followed by separating insoluble solids from the aqueous solution;

C) heating the insoluble solids that have been separated from

B) at a temperature in the range of from about 350° to about 500° C.;

D) compacting the solids.

16. The process of claim 15 wherein the volume of radioactive solids is reduced overall from employing the steps of acid digestion, heating and compacting by about 80 to about 95%.

17. The process of claim 15 wherein the acid used is hydrochloric acid, sulfuric acid, acetic acid or nitric acid.

18. The process of claim 15 wherein the pH is from about 5.0 to about 5.5.

19. The process of claim 18 wherein the acid used is hydrochloric acid or sulfuric acid.

20. The process of claim 18 wherein the acid used is hydrochloric acid and sulfate is added.

* * * * *